US006732777B2

(12) United States Patent
Ertel et al.

(10) Patent No.: US 6,732,777 B2
(45) Date of Patent: May 11, 2004

(54) DISPENSING ADHESIVE IN A BOOKBINDING SYSTEM

(75) Inventors: John P. Ertel, Portola Valley, CA (US); Akinobu Kuramoto, Pleasanton, CA (US); Robert L. Cobene, Santa Clara, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 132 days.

(21) Appl. No.: 09/853,172

(22) Filed: May 9, 2001

(65) Prior Publication Data

US 2002/0168248 A1 Nov. 14, 2002

(51) Int. Cl.[7] ..... B42C 9/00

(52) U.S. Cl. ..... 156/353; 156/360; 156/361; 156/378; 156/543; 156/908; 412/11; 412/14; 412/36; 412/37; 412/900; 412/902

(58) Field of Search ..... 156/64, 256, 267, 156/269, 270, 353, 360, 361, 378, 543, 544, 552, 554, 908; 412/4, 5, 8, 11, 14, 16, 19, 20, 33, 36, 37, 900, 901, 902

(56) References Cited

U.S. PATENT DOCUMENTS

| | | | | | |
|---|---|---|---|---|---|
| 2,788,852 | A | * | 4/1957 | Sharpe | 225/7 |
| 3,296,911 | A | * | 1/1967 | McLane | 83/408 |
| 3,582,010 | A | * | 6/1971 | Whiteman | 242/561 |
| 3,804,694 | A | | 4/1974 | Blair | |
| 3,920,501 | A | | 11/1975 | Carlton | |
| 3,953,277 | A | * | 4/1976 | Kuhns | 156/360 |
| 4,839,943 | A | * | 6/1989 | Leifeld | 19/80 R |
| 5,460,672 | A | * | 10/1995 | Mallonee | 156/73.4 |
| 5,536,044 | A | * | 7/1996 | Luhman et al. | 281/40 |
| 5,678,861 | A | | 10/1997 | Werner | |
| 5,833,423 | A | | 11/1998 | Yamaguchi et al. | |
| 5,842,691 | A | * | 12/1998 | Nakamura | 271/122 |
| 6,000,894 | A | | 12/1999 | Suzuki | |
| 6,129,796 | A | * | 10/2000 | Steinberg et al. | 156/64 |
| 6,460,843 | B1 | * | 10/2002 | Dim et al. | 270/58.07 |

FOREIGN PATENT DOCUMENTS

| | | |
|---|---|---|
| DE | 1486747 B | 10/1970 |
| DE | 2456341 A | 8/1976 |
| WO | WO 89/09129 | 10/1989 |

* cited by examiner

*Primary Examiner*—Richard Crispino
*Assistant Examiner*—Cheryl N. Hawkins

(57) ABSTRACT

Systems and methods of dispensing adhesive in a bookbinding system are described. Sheets may be bound into bound text bodies having respective spines exposed for adhesive application and characterized by multiple length dimensions and multiple thickness dimensions. In one aspect, a sheet binding system comprises an adhesive dispenser that is configured to dispense across the thickness dimension of a text body spine solid sheet adhesive having one of multiple effective widths that is sized to correspond substantially to the length dimension of the text body spine. In accordance with this approach, books of different lengths (or heights) may be readily bound with solid sheet adhesive that may be contained within a single, replaceable cartridge housing.

22 Claims, 9 Drawing Sheets

DISPENSING ADHESIVE IN A BOOKBINDING SYSTEM

CROSS-REFERENCE TO RELATED APPLICATIONS

This application relates to the following co-pending applications, each of which is incorporated herein by reference: U.S. patent application Ser. No. 09/721,549, filed Nov. 24, 2000, by Robert L. Cobene et al., and entitled "SYSTEMS AND METHODS OF ATTACHING A COVER TO A TEXT BODY;" U.S. patent application Ser. No. 09/776,251, filed Feb. 3, 2001, by Robert L. Cobene et al., and entitled "SYSTEMS AND METHODS OF BINDING A TEXT BODY;" and U.S. patent application Ser. No. 09/837,648, filed Apr. 18, 2001, by Akinobu Kuramoto et al., and entitled "DETERMING WHEN ADHESIVE IN A REPLACEABLE ADHESIVE DISPENSER IS NEARLY SPENT."

TECHNICAL FIELD

This invention relates to systems and methods of dispensing adhesive in a bookbinding system.

BACKGROUND

Today, a variety of different bookbinding systems can deliver professionally bound documents, including books, manuals, publications, annual reports, newsletters, business plans, and brochures. A bookbinding system generally may be classified as a commercial (or trade) bookbinding system that is designed for in-line manufacturing of high quality volume runs or an in-house (or office) bookbinding system designed for short "on-demand" runs. Commercial bookbinding systems generally provide a wide variety of binding capabilities, but require large production runs (e.g., on the order of thousands of bindings) to offset the set-up cost of each production run and to support the necessary investment in expensive in-line production equipment. Office bookbinding systems, on the other hand, generally involve manual intervention and provide relatively few binding capabilities, but are significantly less expensive to set up and operate than commercial bookbinding systems, even for short on-demand production runs of only a few books.

In general, a bookbinding system collects a plurality of sheets (or pages) into a text body (or book block) that includes a spine and two side hinge areas. The bookbinding system applies an adhesive to the text body spine to bind the sheets together. A cover may be attached to the bound text body by applying an adhesive to the side hinge areas or the spine of the text body, or both. The cover of a typical commercial soft cover book generally is attached to the text body spine. The covers of hardcover books and some soft cover "lay flat" books, on the other hand, typically are attached to the side hinge areas of the text body and are not attached to the text body spines (i.e., the spines are "floating").

SUMMARY

The invention features novel systems and methods of dispensing adhesive in a bookbinding system. In accordance with this inventive scheme, books of different lengths (or heights) may be readily bound with solid sheet adhesive that may be contained within a single, replaceable cartridge housing.

In one aspect, the invention features a system for binding sheets into bound text bodies having respective spines exposed for adhesive application and characterized by multiple length dimensions and multiple thickness dimensions. The system comprises an adhesive dispenser that is configured to dispense across the thickness dimension of a text body spine solid sheet adhesive having one of multiple effective widths that is sized to correspond substantially to the length dimension of the text body spine.

Embodiments in accordance with this aspect of the invention may include one or more of the following features.

The adhesive dispenser may be configured to dispense multiple segments of solid sheet adhesive along the length dimension of the text body spine. The solid sheet adhesive segments may have different widths or the same width. In some embodiments, the adhesive dispenser may be configured to dispense at least one solid sheet adhesive independently of the other solid sheet adhesive segments. For example, the adhesive dispenser may include a roller system for dispensing the multiple segments of solid sheet adhesive. The roller system may include a drive shaft supporting multiple drive rollers. The adhesive dispenser also may include a motor for driving the drive shaft. A clutch may be disposed between a pair of drive rollers to enable one or both drive rollers of the drive roller pair to be driven selectively by the motor.

An adhesive quantity interrogator may be configured to obtain indications of the length of each solid sheet adhesive segment remaining in a plug-in cartridge housing. A controller may be configured to transmit a warning message when any of the solid sheet adhesive segments is nearly spent.

In some embodiments, the adhesive dispenser is configured to dispense multiple segments of solid sheet adhesive along the length dimension of the text body spine simultaneously. In other embodiments, the adhesive dispenser is configured to dispense multiple segments of solid sheet adhesive along the length dimension of the text body spine sequentially. For example, the adhesive dispenser may be configured to position a plug-in cartridge housing containing a roll of solid sheet adhesive at multiple locations along the length dimension of the text body spine.

In some embodiments, the adhesive dispenser comprises a width cutter for cutting solid sheet adhesive to an effective width substantially corresponding to the length dimension of the text body spine. The adhesive dispenser also may include a length cutter for cutting the solid sheet adhesive to a length at least as large as the thickness dimension of the text body spine. In this embodiment, the adhesive dispenser may be configured to advance the solid sheet adhesive beyond the location cut by the width cutter, and to cut across the solid sheet adhesive with the length cutter to prepare a clean leading edge for a subsequent sheet binding. The adhesive dispenser may include a waste reservoir that is configured to store excess solid sheet adhesive that has been cut by the width cutter.

The invention also features a method of binding sheets into bound text bodies.

Other features and advantages of the invention will become apparent from the following description, including the drawings and the claims.

DETAILED DESCRIPTION

In the following description, like reference numbers are used to identify like elements. Furthermore, the drawings are intended to illustrate major features of exemplary embodiments in a diagrammatic manner. The drawings are not intended to depict every feature of actual embodiments nor relative dimensions of the depicted elements, and are not drawn to scale.

Figure 1:
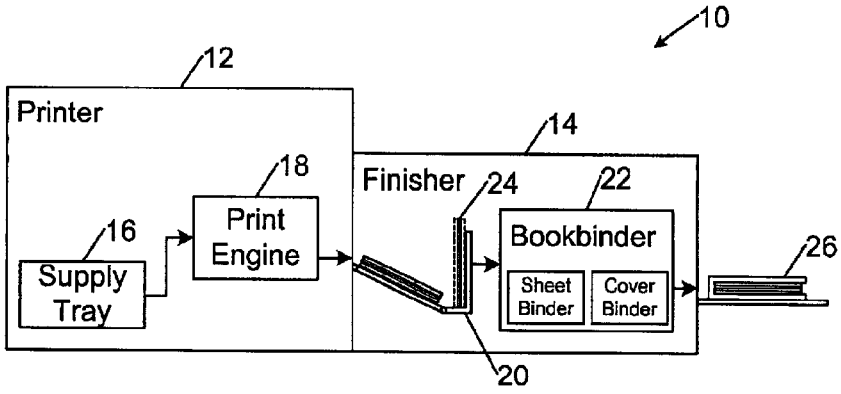
FIG. 1 is a diagrammatic side view of a bookbinding system.

Referring to FIG. 1, in one embodiment, a bookbinding system 10 includes a printer 12 and a finisher 14. Bookbinding system 10 may be implemented as a desktop or office bookmaking system designed to satisfy on-demand bookbinding needs. Printer 12 may be a conventional printer (e.g., a LaserJet® printer available from Hewlett-Packard Company of Palo Alto, Calif., U.S.A.) that includes a supply tray 16 that is configured to hold a plurality of sheets (e.g., paper sheets), and a print engine 18 that is configured to apply markings onto the sheets received from supply tray 16. Finisher 14 includes a sheet collector 20 and a bookbinder 22. Bookbinder 22 includes a sheet binder that is configured to bind the text body sheets to one another, and a cover binder that is configured to attach a cover to the bound text body. In operation, sheets are fed from supply tray 16 to print engine 18, which prints text, pictures, graphics, images and other patterns onto the sheets. The printed sheets are fed to sheet collector 20, which collects and aligns the sheets into a text body 24 with an exposed spine bounded by two exposed side hinge areas. The text body 24 is conveyed to bookbinder 22. The sheet binder binds the sheets of text body 24, and the cover binder attaches a cover to the bound text body to produce a bound book 26 with a floating spine or an attached spine.

Figure 2A:
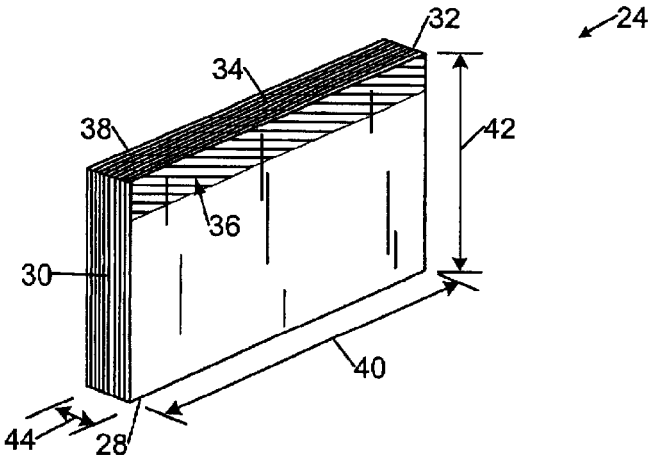
FIG. 2A is a diagrammatic perspective view of a text body formed by collecting and aligning a plurality of sheets.
Figure 2B:
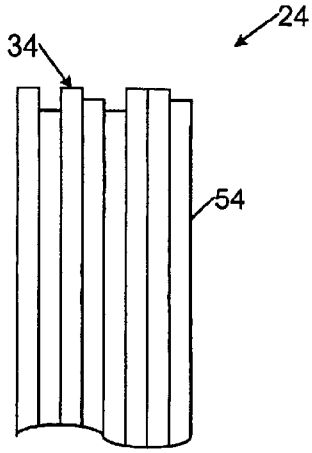
FIG. 2B is a diagrammatic end view of the spinal portion of a text body formed by registering sheets with respect to two datum edges so that variations in sheet width dimension are accommodated in the spine edge of the text body.

Referring to FIGS. 2A and 2B, text body 24 includes a plurality of sheets and is characterized by a front end 28, two sides 30, 32 and a spinal area (or spine) 34, which is located opposite to front end 28. Spine 34 is bounded by two side hinge areas 36, 38. Text body 24 may be characterized by a length (or height) dimension 40, a width dimension 42, and a thickness dimension 44. As shown in FIG. 2B, the spinal area exposed for adhesive penetration may be increased before adhesive is applied by registering and aligning text body sheets 54 with respect to two datum edges. In particular, sheets 54 preferably are aligned with reference to front end 28 of text body 24 and one of the two text body sides 30, 32 so that variations in sheet dimensions are accommodated in the text body width dimension 42 of spinal area 34. As a result, the spinal surface area exposed for adhesive penetration is greater than if all of the sheets 54 were registered and aligned with respect to spine edge 34. Upon cooling, the hot melt adhesive re-solidifies and binds the sheets 54 into a bound text body. A variety of different adhesive compositions may be used to bind the text body sheets, including a conventional paper-backed hot melt sheet adhesive that may be dispensed from a roll and may be obtained from Minnesota Mining and Manufacturing Company (3M), of St. Paul, Minn., United States.

Figure 3:
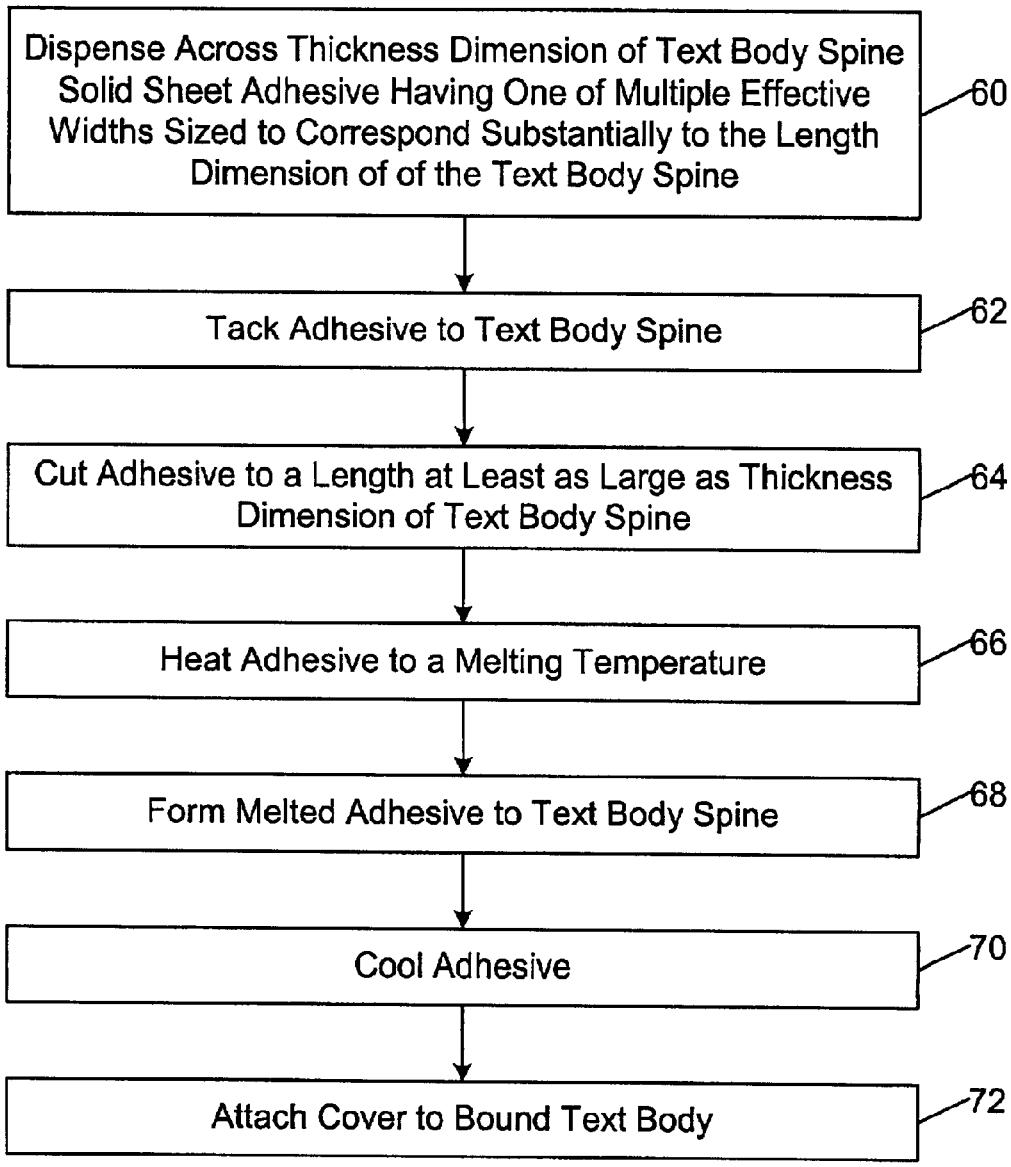
FIG. 3 is a flow diagram of a method of binding sheets into a bound text body.

Referring to FIG. 3, in one sheet binding embodiment, text body 24 may be bound as follows. An adhesive dispensing system dispenses across the thickness dimension of text body spine 34 solid hot melt sheet adhesive having one of multiple effective widths sized to correspond substantially to the length dimension 40 of text body spine 34 (step 60). A spot heater tacks the dispensed adhesive to the text body spine (step 62). The adhesive dispensing system cuts the adhesive to a length that is at least as large as the thickness dimension of text body spine 34, leaving a preformed solid hot melt adhesive tacked to text body spine 34 (step 64). An adhesive heater heats the preformed solid hot melt adhesive to a temperature at or above the melting temperature of the adhesive (step 66). The melted adhesive conforms to the exposed surface features of spinal area 34 and flows into spaces between the ends of sheets 54. An adhesive former forms the melted adhesive to text body spine 34 (step 68). An adhesive cooler cools the formed adhesive until the adhesive re-solidifies to bind the text body sheets into a bound text body (step 70). The resulting bonds between text body sheets 54 are greater than the bonds that would have been formed had the sheets been registered and aligned at spine edge 34. Next, a cover is attached to the bound text body to form a bound book with a floating spine or an attached spine (step 72).

As mentioned above, bookbinding system 10 is configured to bind books of different lengths (or heights) with solid sheet adhesive that may be contained within a single, replaceable cartridge housing. In particular, bookbinding system 10 is configured to assemble text body 24 from sheets of any one of many different sizes (e.g., A5, B5, U.S. Letter, Executive, and A4 sized sheets) and to apply solid sheet adhesive to text body spine 34 to bind the assembled sheets into a bound text body having any one of many different book sizes.

Figure 4A:
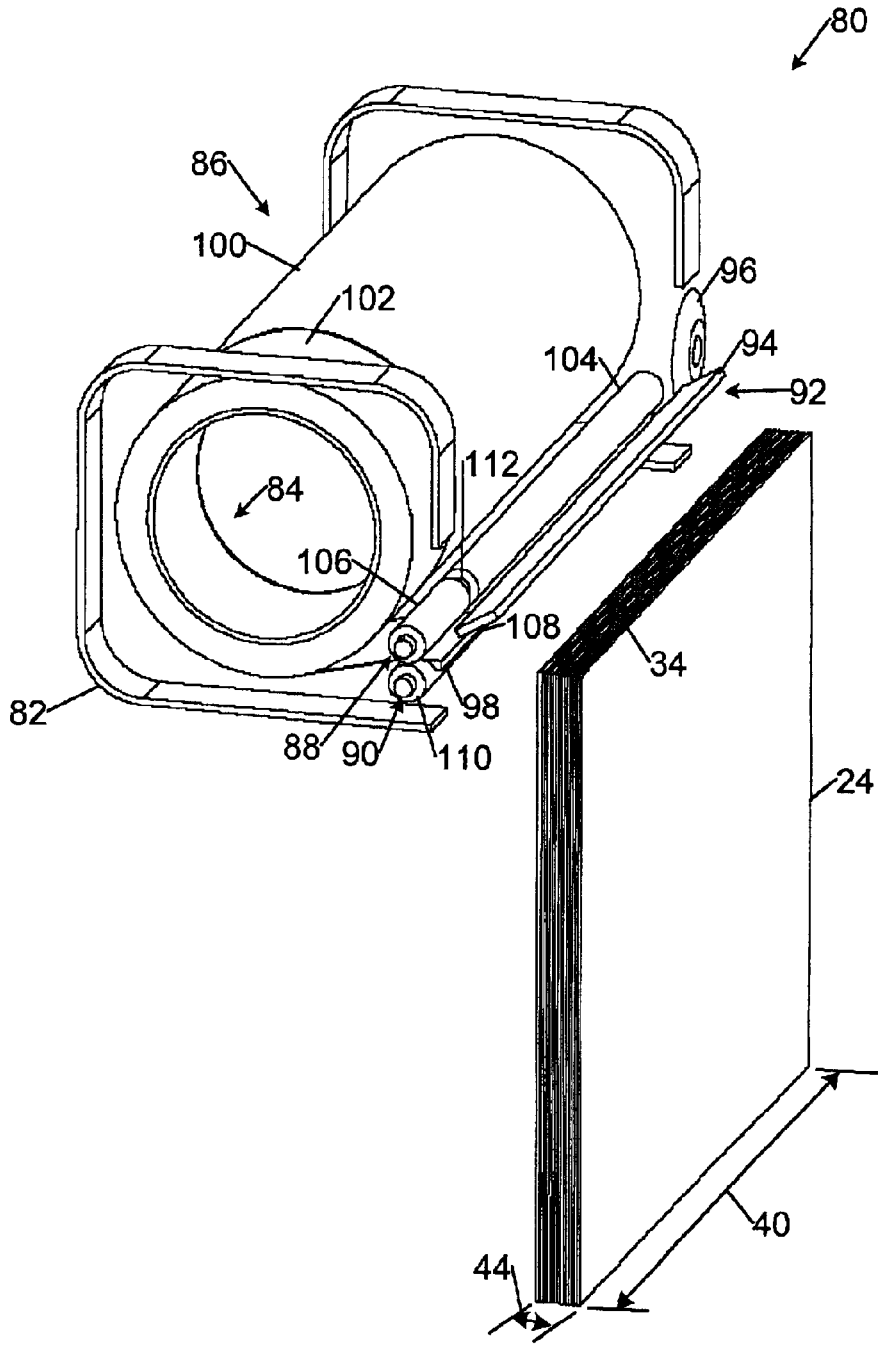
FIG. 4A is a diagrammatic perspective view of an adhesive dispensing system containing multiple segments of solid sheet adhesive, and a text body to be bound.
Figure 4B:
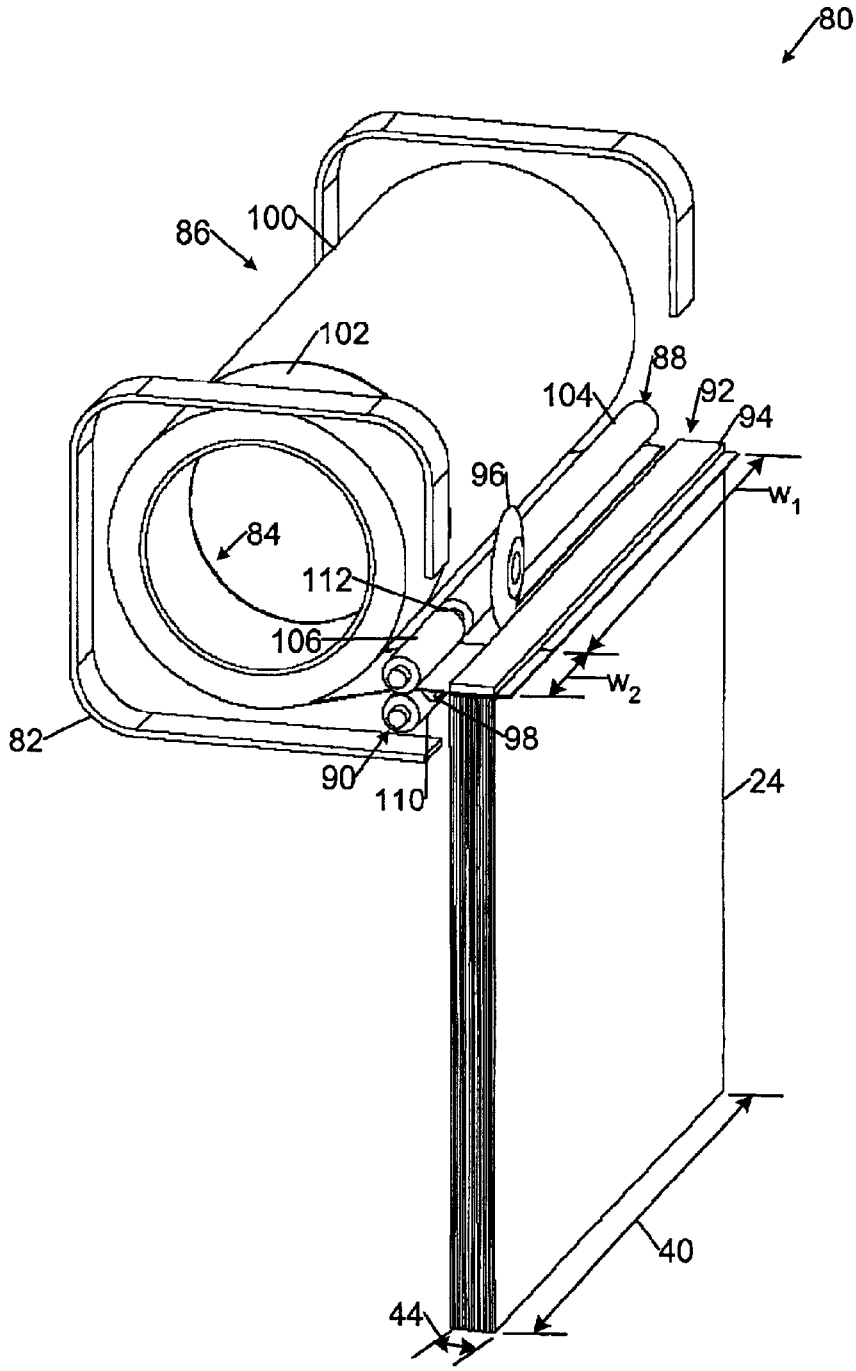
FIG. 4B is a diagrammatic perspective view of the adhesive dispensing system of FIG. 4A dispensing multiple segments of solid sheet adhesive across the thickness dimension of the text body spine, tacking the dispensed solid hot melt adhesive to the text body spine, and cutting the tacked adhesive to a length that is at least as large as the thickness dimension of the text body spine.
Figure 4C:
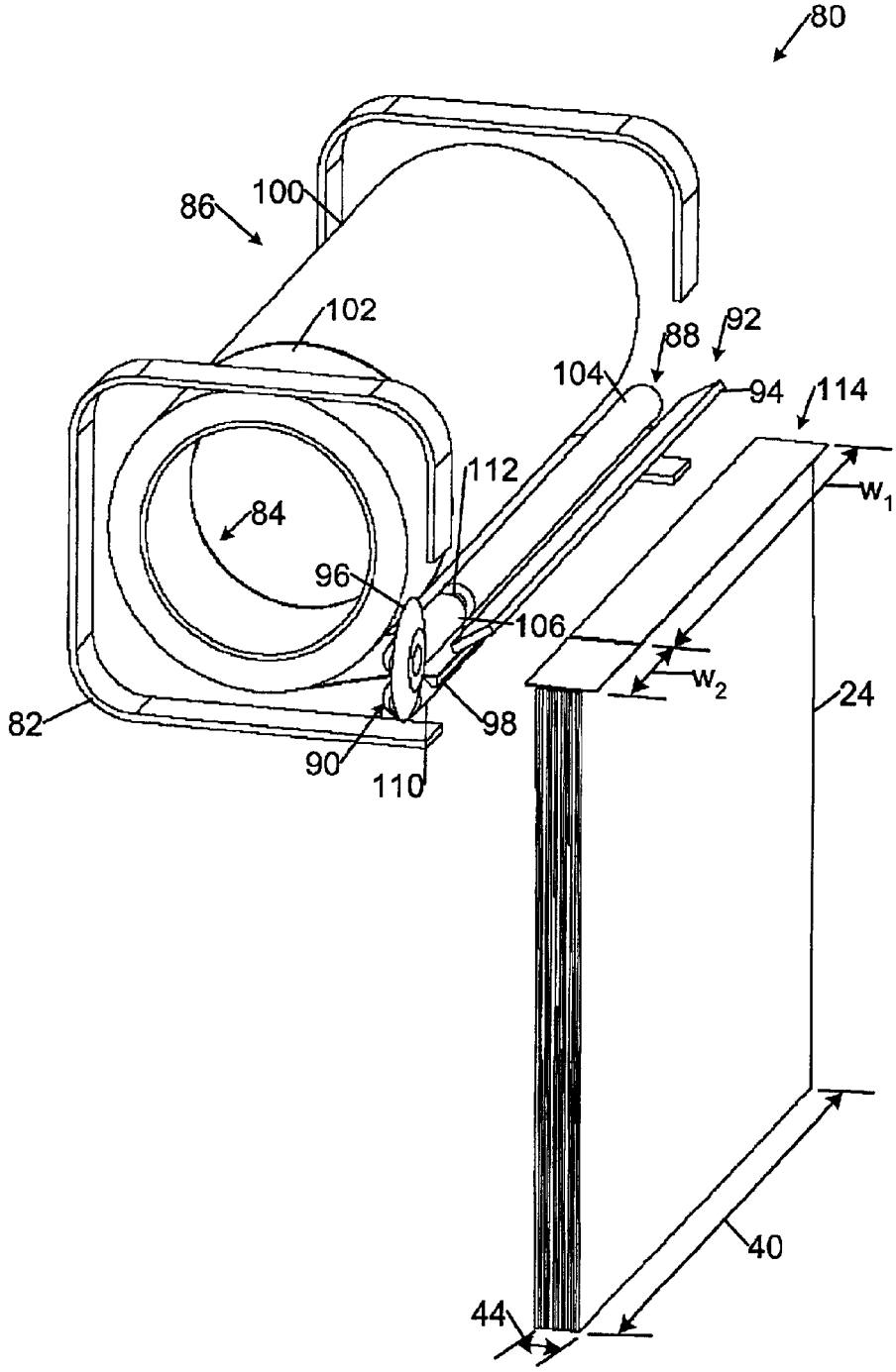
FIG. 4C is a diagrammatic perspective view of the adhesive dispensing system of FIG. 4A and a preformed, segmented solid hot melt adhesive tacked to the text body spine.

Referring to FIGS. 4A–4C, in one embodiment, an adhesive dispensing system 80 includes a cartridge housing 82 that includes a supply spool system 84 supporting a roll of a paper-backed solid hot melt sheet adhesive system 86. Cartridge housing 82 may plug into a corresponding receptacle in bookbinder 22 of finisher 14. The hot melt adhesive is dispensed between a pair of opposed roller systems 88, 90, which draw the hot melt adhesive from supply spool system 84. Adhesive dispensing system 80 also includes a spot heater 92 that is configured to heat one or more localized areas of the hot melt adhesive to a temperature that is sufficient to tack the adhesive to text body spine 34. Spot heater 92 includes an elongated clamp 94 that supports one or more exposed spaced-apart heating elements (e.g., conventional heating strips or resistive wires). The spacing between heating elements may be on the order of 1–4 cm. A cutting wheel 96 is configured to traverse a cutting edge of a cutter bar 98 and, thereby, cut the hot melt adhesive to a length that is at least as large as the thickness dimension 44 of text body spine 34.

As shown in FIG. 4A, solid sheet adhesive system 86 is segmented into two separate adhesive segments 100, 102. In one embodiment, each adhesive segment 100, 102 is formed from the same hot melt adhesive composition disposed on separate paper backing strips. In this embodiment, solid sheet adhesive segments 100, 102 have different widths ($w_1$, $w_2$; see FIG. 4B) so that text body spines of two different widths (i.e., $w^1$ and $w^1+w_2$) may be bound. For example, a solid sheet adhesive system 86 having adhesive segments 100, 102 with respective widths of 9 inches and 2 inches may be used to bind sheets having any one of the following dimensions: 8.5 inches by 11 inches, 6 inches by 9 inches, and 7 inches by 9 inches. In other embodiments, solid sheet adhesive system 86 may include multiple adhesive segments of the same unit width. In these embodiments, the unit width of the adhesive segments may be selected so that one or more adhesive segments may be applied simultaneously to text body spine 34 to provide composite sheet adhesives with effective widths sized to correspond to the multiple different text body spine lengths to be bound.

Supply spool system 84 includes two separate spooling mechanisms that are configured to rotate independently of each other so that adhesive segments 100, 102 may be dispensed independently of each other. In one embodiment, roller systems 88, 90 include pairs of respective rollers 104, 106 and 108, 110, which cooperate to dispense one or both of adhesive segments 100, 102. In particular, rollers 104 and 108 cooperate to dispense adhesive segment 100, and rollers 106, 110 cooperate to dispense adhesive segment 102. In this embodiment, roller system 88 is supported by a drive shaft, which is coupled to a drive motor, and the rollers 108, 110 of roller system 90 operate as idler rollers. A clutch 112 (e.g., an electromagnetic clutch) is configured to selectively engage roller 106 with roller 104 and to selectively disengage roller 106 from roller 104 so that either both rollers 104, 106 are driven simultaneously or only roller 104 is driven.

In another embodiment, one drive motor may be coupled at each end of the drive shaft to drive, with each motor being configured to drive a respective one of rollers 104, 106.

In other embodiments, a single drive motor may be coupled to a common grit roller that cooperates with multiple pinch rollers to dispense multiple adhesive segments from adhesive dispensing system 80. For example, in an embodiment in which solid sheet adhesive system 86 includes multiple adhesive segments of the same unit width, a solenoid-actuated pinch roller (or wheel) may be associated with each adhesive segment and configured to selectively hold the respective adhesive segment in and out of contact with the driving grit roller. In this way, one or multiple adhesive segments may be dispensed to provide a composite sheet adhesive with an effective width that substantially corresponds to the length dimension 40 of text body spine 34.

In another embodiment, rather than having multiple adhesive segments of unit width, adhesive dispensing system 80 may include a single adhesive segment of unit width. In this embodiment, the adhesive segment may be positioned at multiple locations along the length dimension 40 of text body spine 34 so that a series of adhesive strips may be dispensed sequentially over text body spine 34. The resulting series of adhesive strips may have a combined effective width that substantially corresponds to the length dimension 40 of text body spine 34.

Referring to FIGS. 4B and 4C, adhesive dispensing system 80 may be used to bind a text body having a length corresponding to the combined effective width ($w_1+w_2$) of both adhesive segments 100, 102. In this application, adhesive dispensing system 80 initially is brought into contact with a clamping system (not shown) that holds text body 24 in place. Clutch 112 is engaged so that roller systems 88, 90 may dispense both hot melt adhesive segments 100, 102 across text body spine 34 to a desired length, which typically is at least as large as thickness dimension 44. In one embodiment, an optical sensor may be configured to trigger a controller to stop drive rollers 104, 106 upon detection of when the leading edges of hot melt adhesive segments 100, 102 have passed over text body spine 34 by a desired distance. After hot melt adhesive segments 100, 102 have been disposed over text body spine 34, spot heater 92 clamps hot melt adhesive segments 100, 102 to text body spine 34 and cutting wheel 96 cuts hot melt adhesive 78 to the desired length. Spot heater 92 holds hot melt adhesive segments 100, 102 in place while the adhesive segments are being cut and applies sufficient heat and pressure to tack each of the adhesive segments to text body spine 34 at one or more locations. After hot melt adhesive segments 100, 102 have been tacked in place, the heating elements of spot heater 92 may be turned off and adhesive dispensing system 80 may be withdrawn (FIG. 4C). The tack bonds hold the resulting preformed hot melt adhesive segments 100, 102 to text body spine 34 with sufficient force to prevent the preformed hot melt adhesive 114 from becoming displaced during subsequent processing steps and to prevent the sheets of text body 24 from moving.

Figure 5:
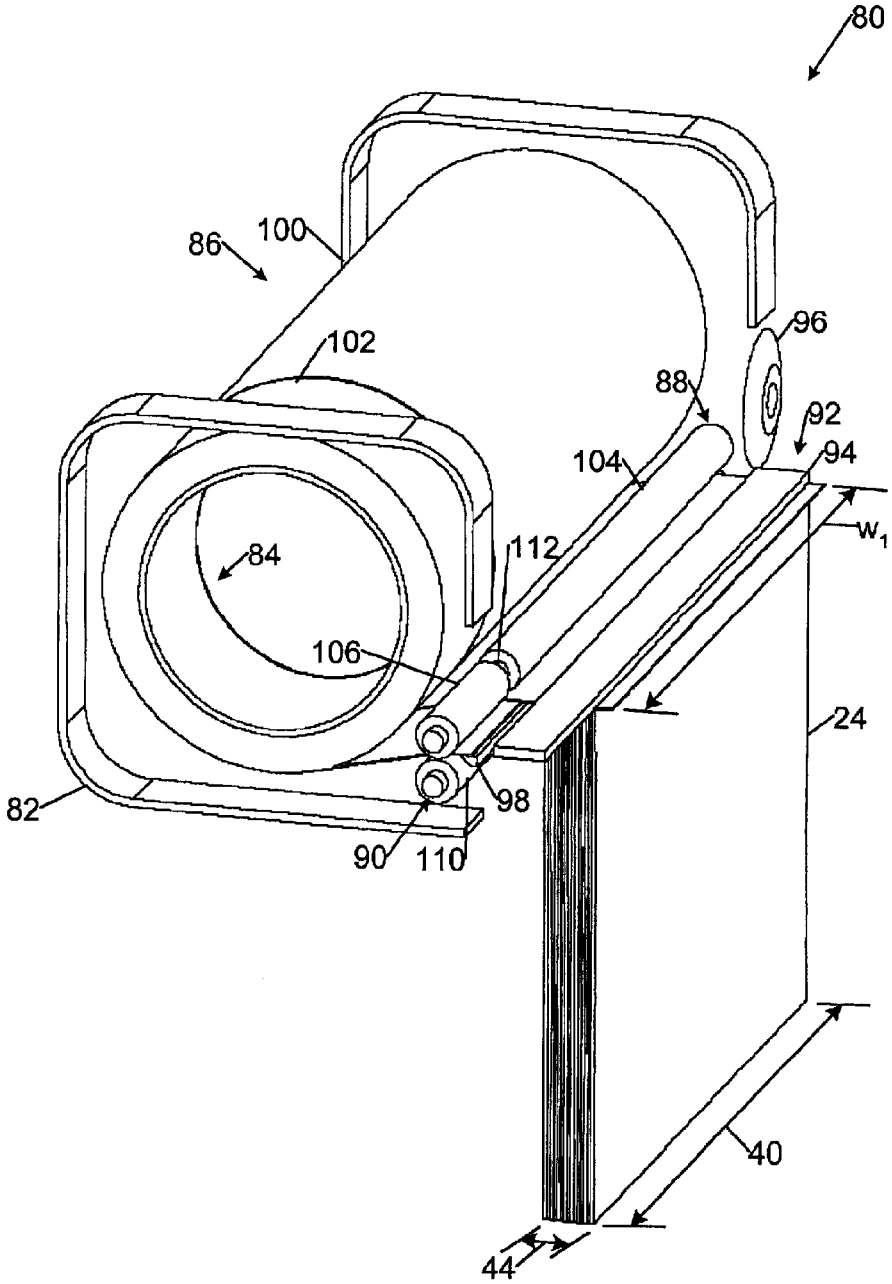
FIG. 5 is a diagrammatic perspective view of the adhesive dispensing system of FIG. 4A dispensing one of the multiple segments of solid sheet adhesive across the thickness dimension of a text body and tacking the dispensed solid hot melt adhesive segment to the text body spine.

As shown in FIG. 5, adhesive dispensing system 80 may be used to bind a text body having a length corresponding to the width ($w_1$) of adhesive segment 100. In this application, clutch 112 is not engaged so that roller systems 88, 90 may dispense only hot melt adhesive segment 100 across text body spine 34 to a desired length.

Figure 6:
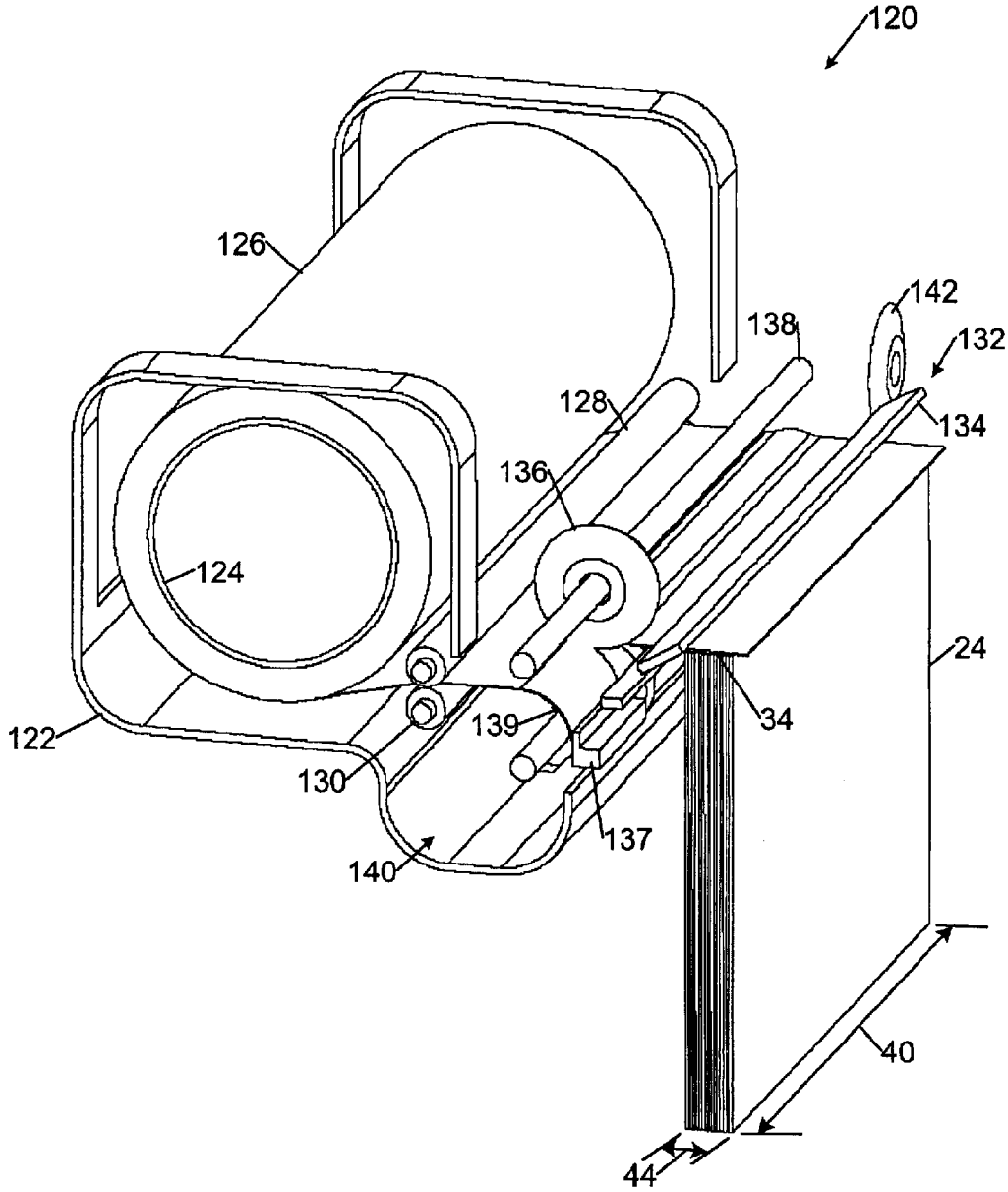
FIG. 6 is a diagrammatic perspective view of an adhesive dispensing system cutting an un-segmented solid sheet adhesive to a width corresponding to the length dimension of a text body spine, dispensing the cut adhesive across the thickness dimension of the text body spine, and tacking the dispensed adhesive to the text body spine.

Referring to FIG. 6, in another embodiment, an adhesive dispensing system 120 includes a cartridge housing 122 that includes a supply spool 124 supporting a roll of an un-segmented, paper-backed solid hot melt sheet adhesive 126. Cartridge housing 122 may plug into a corresponding receptacle in bookbinder 22. The hot melt adhesive is dispensed between a pair of opposed rollers 128, 130, which draw the hot melt adhesive from supply spool 124. Adhesive dispensing system 120 also includes a spot heater 132 that is configured to heat one or more localized areas of the hot melt adhesive to a temperature that is sufficient to tack the adhesive to text body spine 34. Spot heater 132 includes an elongated clamp 134 that supports one or more exposed spaced-apart heating elements (e.g., conventional heating strips or resistive wires). The spacing between heating elements may be on the order of 1–4 cm. A width cutting wheel 136 may be positioned at different locations along a support rod 138 to cut the hot melt adhesive to a width that corresponds substantially to the length dimension 40 of text body spine 34. Excess hot melt adhesive 139 that is cut by width cutting wheel 136 is collected in a waste reservoir 140 of cartridge housing 122. A length cutting wheel 142 is configured to traverse a cutting edge of a cutter bar (not shown) and, thereby, cut the hot melt adhesive to a length that is at least as large as the thickness dimension 44 of text body spine 34. Cutter wheel 137, in turn, cuts the corresponding excess hot melt adhesive such that the cut edge corresponds to the length of the edge cut by length cutting wheel 142. In this embodiment, after sheet adhesive 126 has been dispensed, tacked in place and cut to length, adhesive dispensing system 120 is configured to retract the solid sheet adhesive behind cutting wheel 136 to prepare a clean leading edge for a subsequent sheet binding. Length cutting wheel 136 may be positioned for the next text body to be bound, or parked at a position beyond the width of adhesive roll 126.

The resulting preformed hot melt adhesive 114 may be processed to bind text body 24 by a compact, multi-function sheet binder, as described in U.S. Ser. No. 09/776,251, filed Feb. 3, 2001. The multi-function sheet binder is configured to melt the preformed hot melt adhesive 114, form the melted adhesive, and actively cool the formed hot melt adhesive.

A cover may be attached to the resulting bound text body as follows.

Figure 7A:
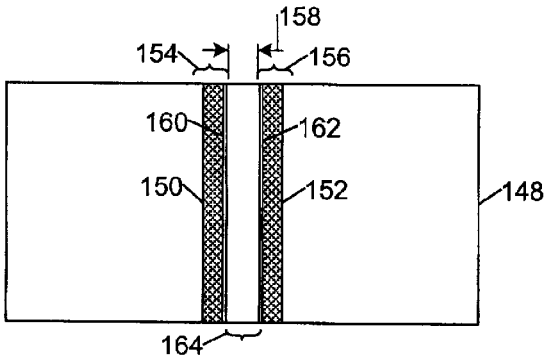
FIG. 7A is a diagrammatic front view of a cover with two strips of pressure sensitive adhesive applied to areas corresponding to the side hinge areas of a bound text body.
Figure 7B:
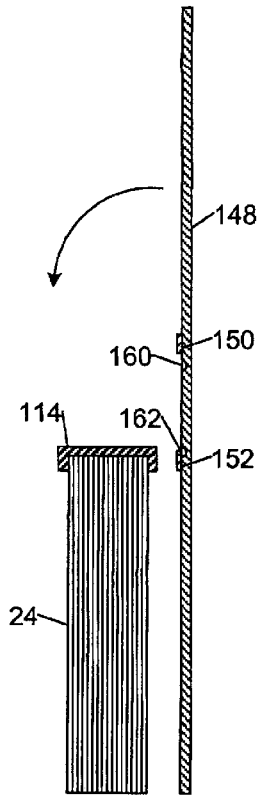
FIG. 7B is a diagrammatic end view of the cover of FIG. 7A being folded over a bound text body.
Figure 7C:
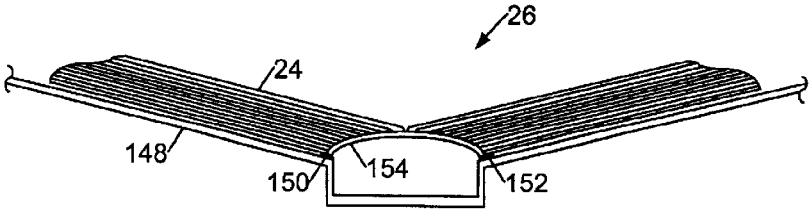
FIG. 7C is a diagrammatic end view of an open bound book with a floating spine formed by attaching the cover of FIG. 7A to the bound text body of FIG. 7B.

Referring to FIGS. 7A–7C, in one embodiment, a solid pressure sensitive adhesive film is applied to a cover 148 as two strips 150, 152 in cover areas 154, 156 that correspond to side hinge areas 36, 38 of text body 24. Pressure sensitive adhesive strips 150, 152 are spaced apart by a width dimension 158 that is at least as wide as the thickness dimension 44 of text body spine 34. As shown in FIG. 7B, cover 148 is aligned with respect to the same datum edges used to align the sheets of text body 24, cut to size, and folded over the bound text body 24. Cover 148 preferably is scored along a pair of score lines 160, 162 to allow cover 148 preferentially to fold over spinal area 34 of text body 24. Pressure is applied to cover areas 154, 156 to activate pressure sensitive adhesive strips 150, 152 and, thereby, attach cover 148 to text body 24. As shown in FIG. 7C, the resulting perfectly bound book 26 has a floating spine that enables the book 26 to lay flat when opened.

Figure 8:
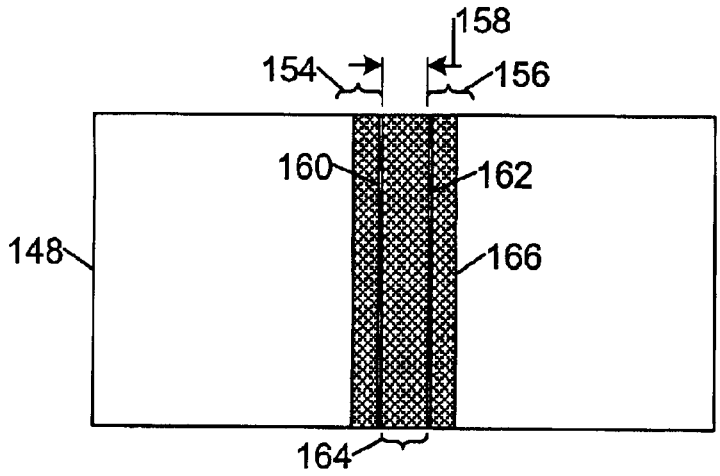
FIG. 8 is a diagrammatic front view of a cover with a single strip of pressure sensitive adhesive applied to an area corresponding to the spine and side hinge areas of the bound text body of FIG. 7B.
Figure 9:
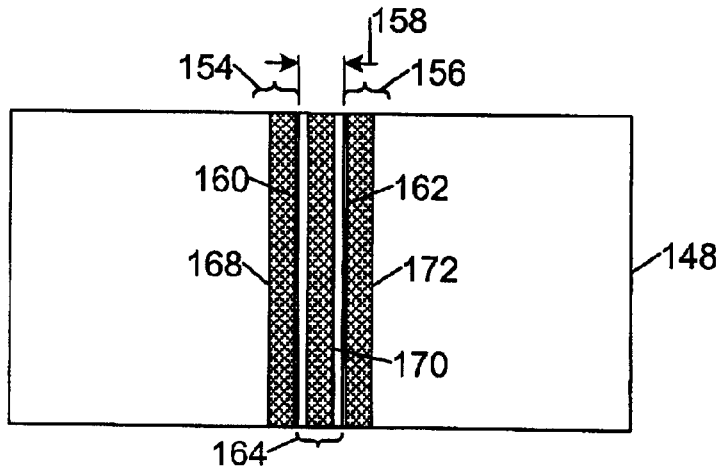
FIG. 9 is a diagrammatic front view of a cover with multiple strips of pressure sensitive adhesive applied to an area corresponding to the spine and side hinge areas of the bound text body of FIG. 7B.

As shown in FIGS. 8 and 9, text body 24 may be bound to cover 148 with an attached spine construction by applying a solid pressure sensitive adhesive film to a cover area 164 that corresponds to text body spine 34. The solid pressure sensitive adhesive film may be applied as a single continuous strip 166 over cover areas 154, 156, and 164 (FIG. 8), or in a series of multiple strips 168, 170, 172 over cover areas 154, 156, and 164 (FIG. 9).

As used herein, "pressure sensitive adhesives" refer to a class of adhesive compositions that are applied with pressure and generally do not undergo a liquid to solid transition in order to hold materials together. Pressure sensitive adhesives may be solvent-free natural or synthetic resins characterized by the rapid wetting of a surface to form an adhesive bond upon contact with the surface under pressure.

As explained above, in some embodiments, the replaceable cartridge housings for the solid hot melt sheet adhesives are configured to plug into one or more respective receptacles in bookbinder 22 of finisher 14. In these embodiments, bookbinder 22 may be configured to obtain automatically an indication of the length of solid sheet adhesives remaining within each of the plug-in cartridge housings 74, 142. Bookbinder 22 also may be configured to replace automatically an exhausted adhesive dispenser with a new adhesive dispenser of an adhesive stack that has been loaded into bookbinder 22 based upon a signal received from a sensor. After each of the loaded adhesive dispensers has been exhausted, bookbinder 22 may display a notice indicating that another adhesive dispenser stack should be loaded into the system. In embodiments in which multiple segments of adhesive are dispensed from a replaceable cartridge housing, bookbinder 22 may include an adhesive quantity interrogator that is configured to obtain indications of the remaining length of each of the adhesive segments contained within the cartridge housing. A controller may be configured to transmit a warning message when any of the solid sheet adhesive segments in the replaceable cartridge housing is nearly spent. Further details regarding systems and methods for obtaining indications of the lengths of adhesive remaining within a replaceable cartridge housing may be obtained from U.S. patent application Ser. No. 09/837,648, filed Apr. 18, 2001, by Akinobu Kuramoto et al., and entitled "DETERMING WHEN ADHESIVE IN A REPLACEABLE ADHESIVE DISPENSER IS NEARLY SPENT."

Other embodiments are within the scope of the claims.

What is claimed is:

1. A bookbinding system for binding sheets into bound text bodies having respective spines exposed for adhesive application and characterized by multiple length dimensions and multiple thickness dimensions, the system comprising:

a sheet collector configured to assemble a text body from multiple sheets; and an adhesive dispenser positioned to receive an assembled text body from the sheet collector and configured to dispense across the thickness dimension of the spine of the received text body solid sheet adhesive having one of multiple effective widths sized to correspond substantially to the length dimension of the spine of the received text body.

2. The system of claim 1, wherein the adhesive dispenser is configured to dispense multiple segments of solid sheet adhesive along the length dimension of the text body spine.

3. The system of claim 2, wherein the adhesive dispenser is configured to dispense solid sheet adhesive segments of different widths.

4. The system of claim 2, wherein the adhesive dispenser is configured to dispense solid sheet adhesive segments of the same width.

5. The system of claim 2, wherein the adhesive dispenser is configured to dispense at least one solid sheet adhesive segment independently of the other solid sheet adhesive segments.

6. The system of claim 5, wherein the adhesive dispenser comprises a roller system for dispensing the multiple segments of solid sheet adhesive.

7. The system of claim 6, wherein the roller system comprises a drive shaft supporting multiple drive rollers.

8. The system of claim 7, wherein the adhesive dispenser comprises a motor for driving the drive shaft, and a clutch disposed between a pair of drive rollers enables one or both drive rollers of the drive roller pair to be driven selectively by the motor.

9. The system of claim 2, further comprising an adhesive quantity interrogator configured to obtain indications of the length of each solid sheet adhesive segment remaining in a plug-in cartridge housing.

10. The system of claim 9, further comprising a controller configured to transmit a warning message when any of the solid sheet adhesive segments is nearly spent.

11. The system of claim 2, wherein the adhesive dispenser is configured to dispense multiple segments of solid sheet adhesive along the length dimension of the text body spine simultaneously.

12. The system of claim 2, wherein the adhesive dispenser is configured to dispense multiple segments of solid sheet adhesive along the length dimension of the text body spine sequentially.

13. The system of claim 12, wherein the adhesive dispenser is configured to position a plug-in cartridge housing containing a roll of solid sheet adhesive at multiple locations along the length dimension of the text body spine.

14. The system of claim 1, wherein the adhesive dispenser comprises a width cutter for cutting solid sheet adhesive to an effective width substantially corresponding to the length dimension of the text body spine.

15. The system of claim 14, wherein the adhesive dispenser further comprises a length cutter for cutting the solid sheet adhesive to a length at least as large as the thickness dimension of the text body spine.

16. The system of claim 15, wherein the adhesive dispenser is configured to advance the solid sheet adhesive beyond the location cut by the width cutter, and to cut across the solid sheet adhesive with the length cutter to prepare a clean leading edge for a subsequent sheet binding.

17. The system of claim 14, wherein the adhesive dispenser comprises a waste reservoir configured to store excess solid sheet adhesive cut by the width cutter.

18. The system of claim 16, wherein the adhesive dispenser is configured to automatically advance the solid sheet adhesive beyond the location cut by the width cutter, and to automatically cut across the solid sheet adhesive with the length cutter to prepare a clean leading edge free of any cuts by the width cutter for a subsequent sheet binding.

19. The system of claim 1, wherein the solid sheet adhesive dispensed by the adhesive dispenser comprises a hot melt adhesive, and further comprising a heater configured to melt the hot melt adhesive.

20. The system of claim 19, further comprising a cover binder configured to attach a cover to the text body.

21. The system of claim 1, wherein the adhesive dispenser is configured to automatically dispense the solid sheet adhesive across the thickness dimension of the spine of the received text body without manual assistance.

22. The system of claim 15, wherein the length cutter is configured to automatically cut the solid sheet adhesive without manual assistance.

* * * * *